US010576763B2

(12) United States Patent
Ota et al.

(10) Patent No.: US 10,576,763 B2
(45) Date of Patent: Mar. 3, 2020

(54) TAPE CASSETTE

(71) Applicant: BROTHER KOGYO KABUSHIKI KAISHA, Nagoya, Aichi (JP)

(72) Inventors: Yoshihiro Ota, Aichi (JP); Keisuke Nishihara, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 16/112,082

(22) Filed: Aug. 24, 2018

(65) Prior Publication Data

US 2019/0061395 A1 Feb. 28, 2019

(30) Foreign Application Priority Data

Aug. 25, 2017 (JP) ..... 2017-161859

(51) Int. Cl.

| | |
|---|---|
| ***B41J 15/04*** | (2006.01) |
| ***B41J 17/32*** | (2006.01) |
| ***B41J 35/36*** | (2006.01) |
| ***B41J 35/28*** | (2006.01) |
| ***B41J 17/36*** | (2006.01) |
| ***B41J 2/32*** | (2006.01) |
| *B41J 32/00* | (2006.01) |

(52) U.S. Cl.

CPC ..... *B41J 15/044* (2013.01); *B41J 2/32* (2013.01); *B41J 17/32* (2013.01); *B41J 17/36* (2013.01); *B41J 35/28* (2013.01); *B41J 35/36* (2013.01); *B41J 32/00* (2013.01)

(58) Field of Classification Search

CPC . B41J 15/044; B41J 17/36; B41J 35/28; B41J 35/36; B41J 17/32; B41J 2/32; B41J 32/00

See application file for complete search history.

(56) References Cited

U.S. PATENT DOCUMENTS

| | | | | |
|---|---|---|---|---|
| 8,011,772 B2 * | 9/2011 | Kimura | B41J 2/16523 347/84 |
| 2002/0015261 A1 * | 2/2002 | Kano | G11B 15/07 360/132 |
| 2010/0245468 A1 * | 9/2010 | Yamada | B41J 2/17513 347/36 |

FOREIGN PATENT DOCUMENTS

JP 2012-232462 A 11/2012

* cited by examiner

*Primary Examiner* — Yaovi M Ameh

(74) *Attorney, Agent, or Firm* — Scully, Scott, Murphy & Presser, PC

(57) ABSTRACT

A tape cassette configured to accommodate a tape has a cassette case having first-sixth outer walls, a substrate having first and second surfaces. A storage is provided to the second surface. The third wall is formed with a first recess having a bottom wall, which is formed with a second recess or a hole. The substrate is arranged in the first recess with an adhesive layer being sandwiched between the bottom wall and the second surface. The storage or a molded part protecting the storage is arranged in the second recess or the hole. The first recess is formed with an opening part, at least a part of the adhesive layer being accessible through the opening part, and the cassette case is provided with a blocking member overlapping the one of the storage and the molded part in a first direction at the particular position.

13 Claims, 9 Drawing Sheets

TAPE CASSETTE

CROSS-REFERENCE TO RELATED APPLICATIONS

This application claims priority under 35 U.S.C. § 119 from Japanese Patent Application No. 2017-1618599 filed on Aug. 25, 2017. The entire subject matter of the application is incorporated herein by reference.

BACKGROUND

Technical Field

The present disclosures relate to a tape cassette.

Related Art

Conventionally, a tape cassette used for printing an image on a tape-like medium has been known. An example of a conventional tape cassette has a casing having a rectangular box shape, and containing tapes used for printing therein.

SUMMARY

Typically, a tape cassette accommodates a substrate having a storage configured to store information regarding the tape cassette is attached to an outer wall of a casing of the tape cassette so that a tape printer can retrieve the information stored in the storage of the substrate of the tape cassette loaded to the printer.

In such a tape cassette, there is a case where a worker removes the substrate from the outer wall of the casing in order to reuse the substrate. For this purpose, the tape cassette should be configured such that the worker can remove the substrate from the outer wall easily. It should be noted that, when the tape cassette is configured such that the substrate is removable from the outer wall, it is necessary that the storage, which is mounted by the substrate, is not damaged when removed from the outer wall.

According to aspects of the present disclosures, there is provided a tape cassette configured to accommodate a tape, which is provided with a box-like cassette case having a first outer wall, a second outer wall, a third outer wall, a fourth outer wall, a fifth outer wall and a sixth outer wall, the first outer wall and the second outer wall extending in parallel and being arranged in a first direction perpendicular to both the first outer wall and the second outer wall, the third outer wall and the fourth outer wall extending in parallel and being arranged in a second direction perpendicular to both the third outer wall and the fourth outer wall, the fifth outer wall and the sixth outer wall extending in parallel and being arranged in a third direction perpendicular to both the fifth outer wall and the sixth outer wall, and the first direction, the second direction and the third direction are perpendicular to each other. The tape cassette is further provided with a substrate having a first surface and a second surface opposite to the first surface, a storage being provided to the second surface. The third wall is formed with a first recess recessed in a fourth direction which is a one-way direction of the second direction directed from the third wall toward the fourth wall, the first recess having a bottom wall intersecting with the second direction. The bottom wall is formed with one of a second recess recessed in the fourth direction and a hole penetrating through the bottom wall in the fourth direction. The substrate is arranged in the first recess with the first surface facing a direction opposite to the fourth direction and with an adhesive layer being sandwiched between the bottom wall and the second surface. One of the storage and a molded part protecting the storage is arranged in the one of the second recess and the hole. The first recess is formed with an opening part at a particular position in the second direction, at least a part of the adhesive layer being accessible along the first direction through the opening part, and the cassette case is provided with a blocking member overlapping the one of the storage and the molded part in the first direction at the particular position.

According to aspects of the present disclosures, there is provided a tape cassette configured to accommodate a tape, which is provided with a box-like cassette case having a first outer wall, a second outer wall, a third outer wall, a fourth outer wall, a fifth outer wall and a sixth outer wall, the first outer wall and the second outer wall extending in parallel and being arranged in a first direction perpendicular to both the first outer wall and the second outer wall, the third outer wall and the fourth outer wall extending in parallel and being arranged in a second direction perpendicular to both the third outer wall and the fourth outer wall, the fifth outer wall and the sixth outer wall extending in parallel and being arranged in a third direction perpendicular to both the fifth outer wall and the sixth outer wall, and the first direction, the second direction and the third direction are perpendicular to each other. The tape cassette is further provided with a particular recess provided to the fifth outer wall, the particular recess being recessed in a direction from the fifth outer wall to the sixth outer wall, the particular recess having a first side wall extending from the fifth outer wall toward the sixth outer wall and a second side wall extending from the fifth outer wall toward the sixth outer wall, a distance between the second side wall and the fourth outer wall being smaller than a distance between the first side wall and the fourth outer wall, a first discharging port allowing the tape to be discharged from inside to outside of the cassette case, an entering port through which the tape discharged from the first discharging port entering the cassette case again, a second discharging port allowing the tape entered through the entering port to be discharged to outside of the cassette case, a substrate having a first surface and a second surface, the second surface being a surface opposite to the first surface, a storage being provided to the second surface, and an arrangement part provided to the third outer wall, the substrate being arranged on the arrangement part. The first discharging port is provided to the first side wall. The entering port is provided to the second side wall. The second discharging portion is provided to the fourth outer wall. The substrate is arranged on the arrangement part such that the first surface is directed in a direction opposite to a fourth direction, which is a one-way direction directed from the third outer wall toward the fourth outer wall, of the second direction with an adhesive layer being sandwiched between the arrangement part and the substrate, and the adhesive layer is accessible from outside of the cassette case.

BRIEF DESCRIPTION OF THE ACCOMPANYING DRAWINGS

Figure 5:
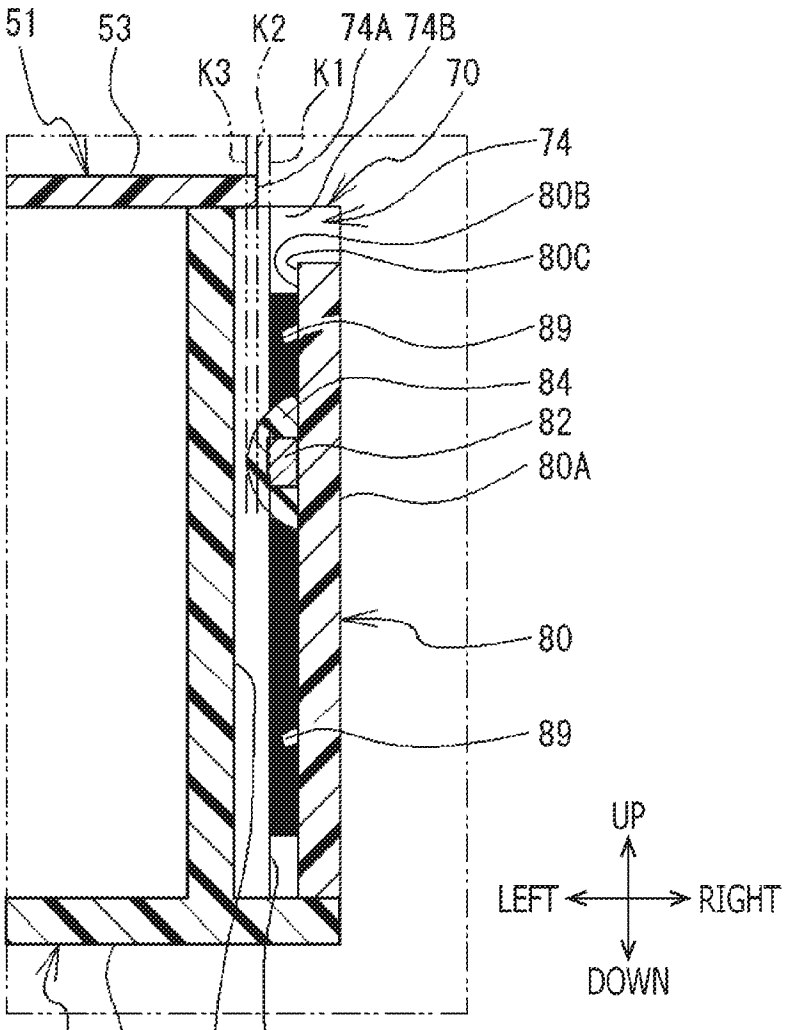
Figure 4:
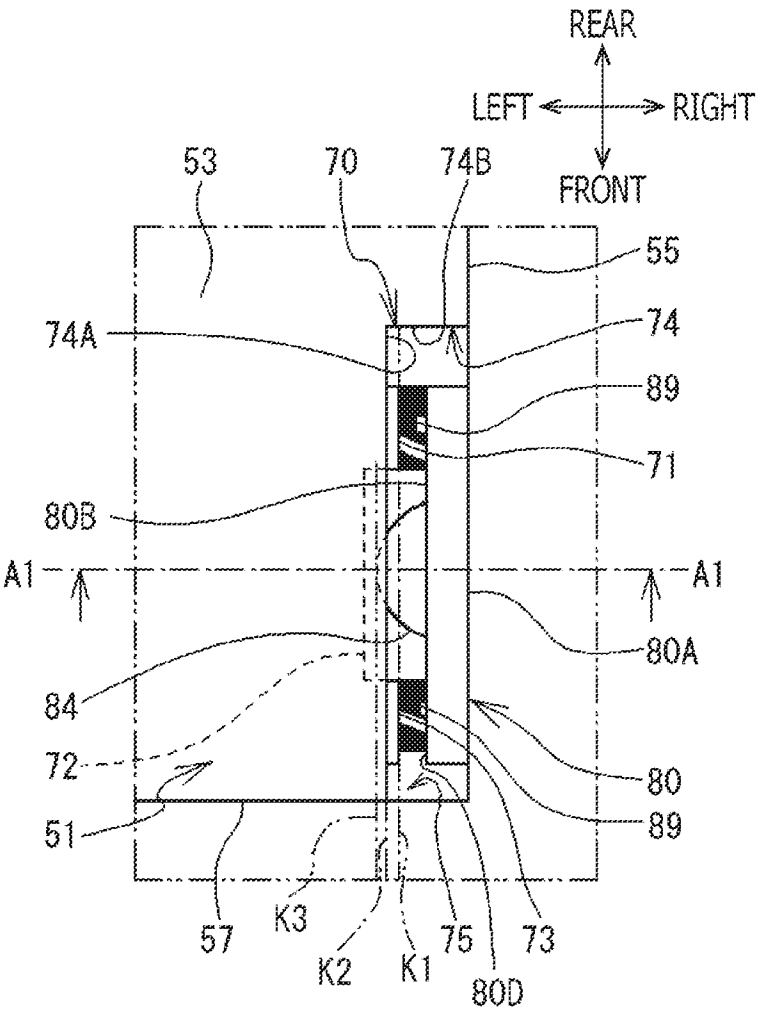
FIG. 4 is a plan view schematically showing a right front part of the tape cassette according to the illustrative embodiment.

FIG. 5 schematically shows a cross-sectional view of the tape cassette taken along line A1-A1 and viewed from arrows shown in FIG. 4.

Figure 6:
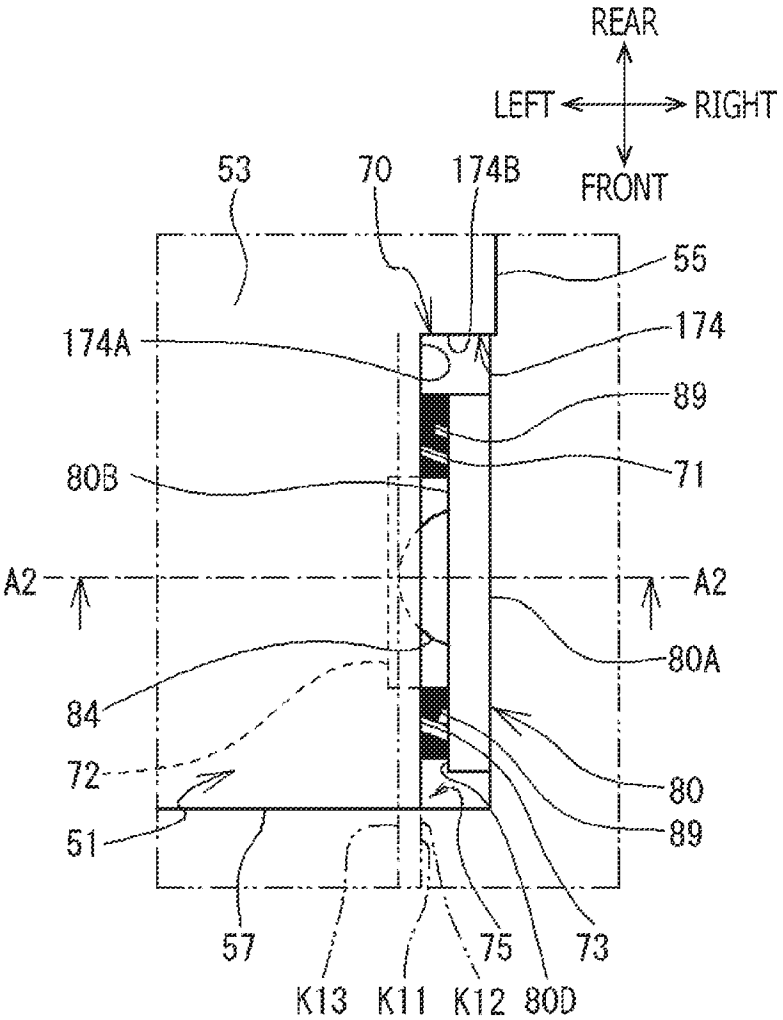

FIG. 6 is a plan view schematically showing a right front part of a tape cassette according to a first modification.

Figure 7:
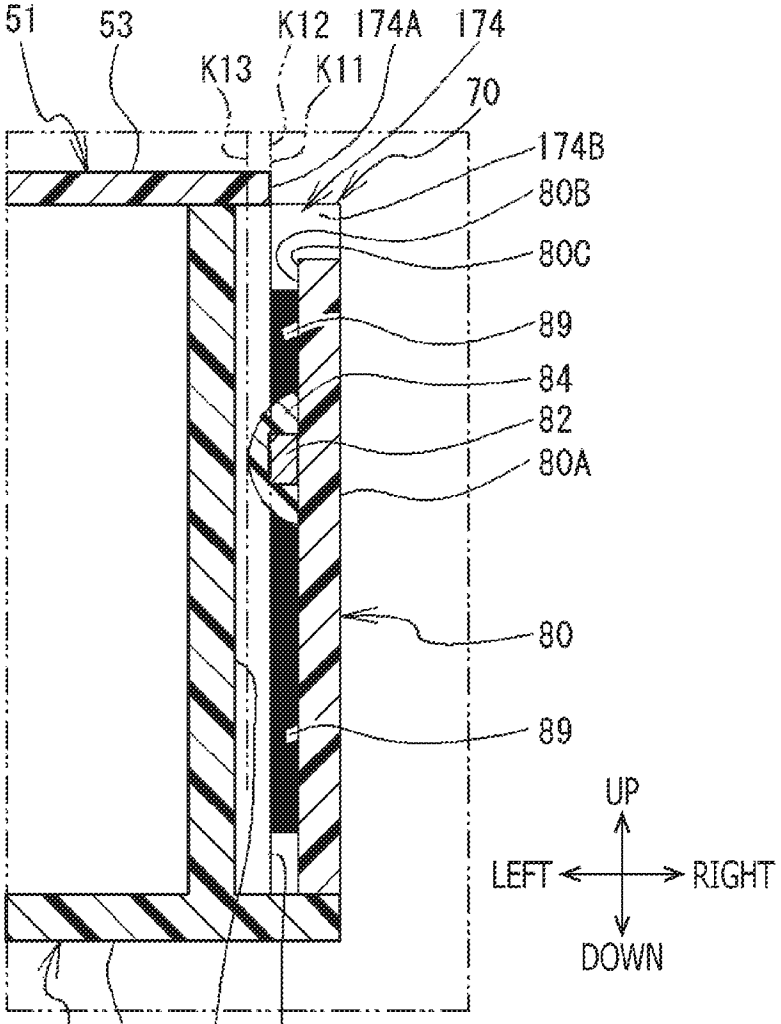

FIG. 7 schematically shows a cross-sectional view of the tape cassette taken along line A2-A2 and viewed from arrows shown in FIG. 6.

Figure 8:
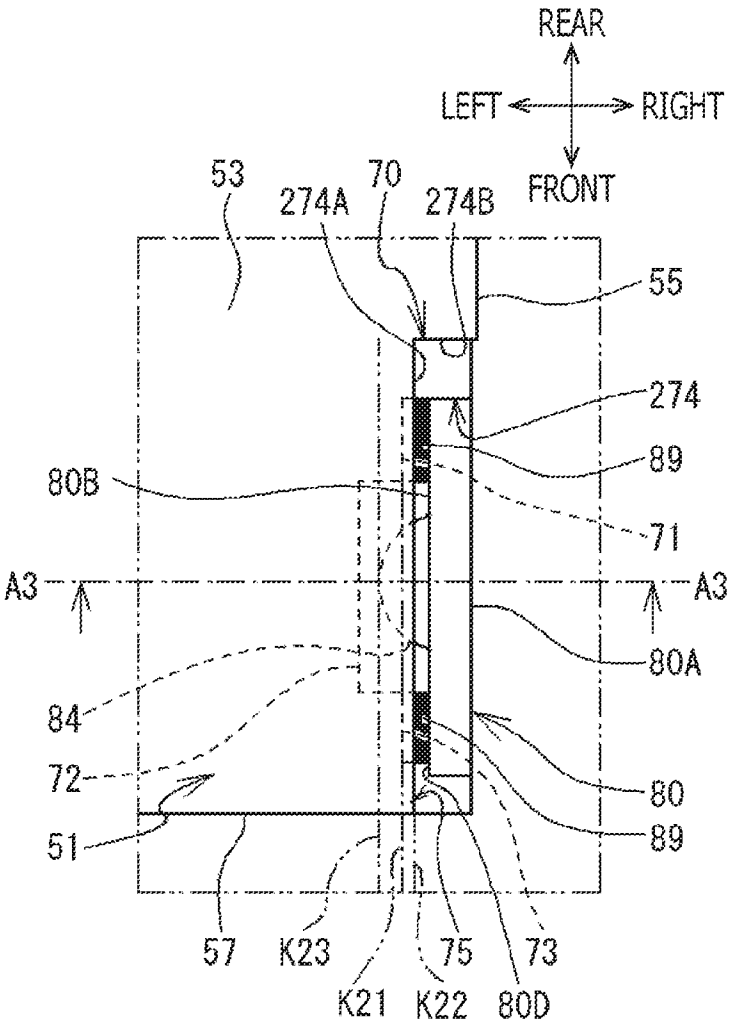

FIG. 8 a plan view schematically showing a right front part of a tape cassette according to a second modification.

Figure 9:
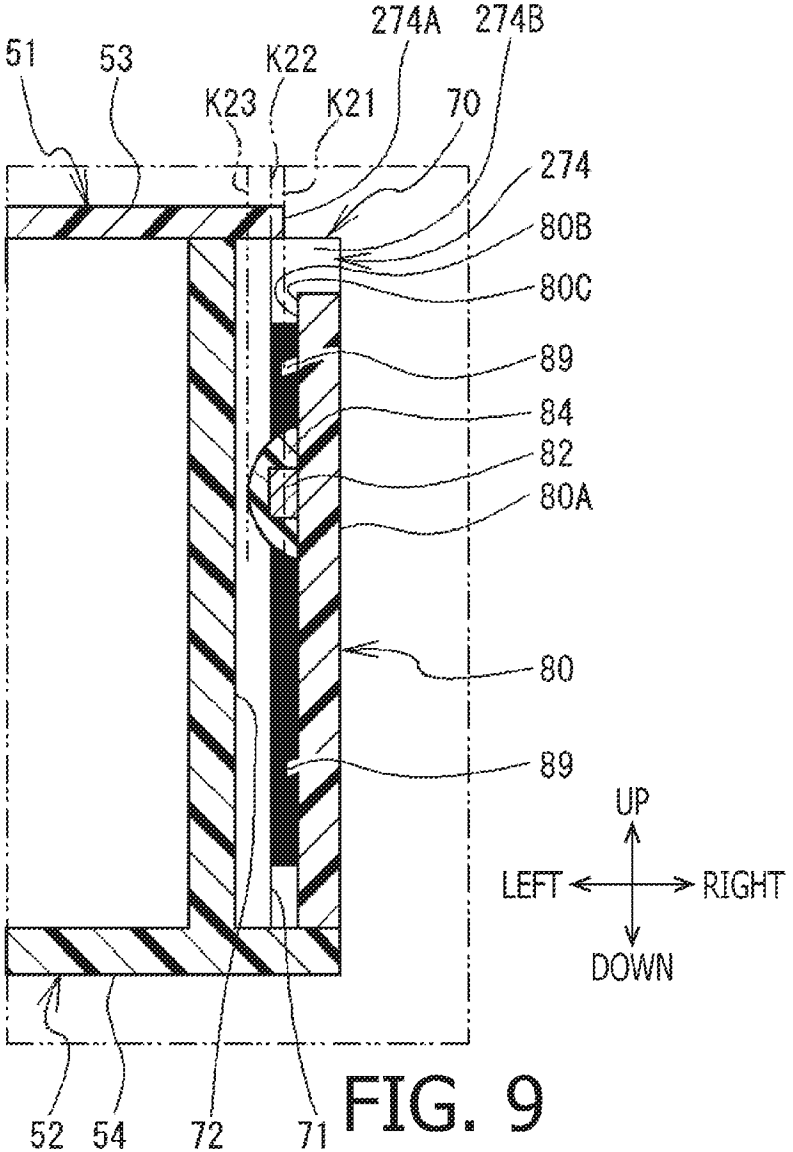

FIG. 9 schematically shows a cross-sectional view of the tape cassette taken along line A3-A3 and viewed from arrows shown in FIG. 8.

Figure 10:
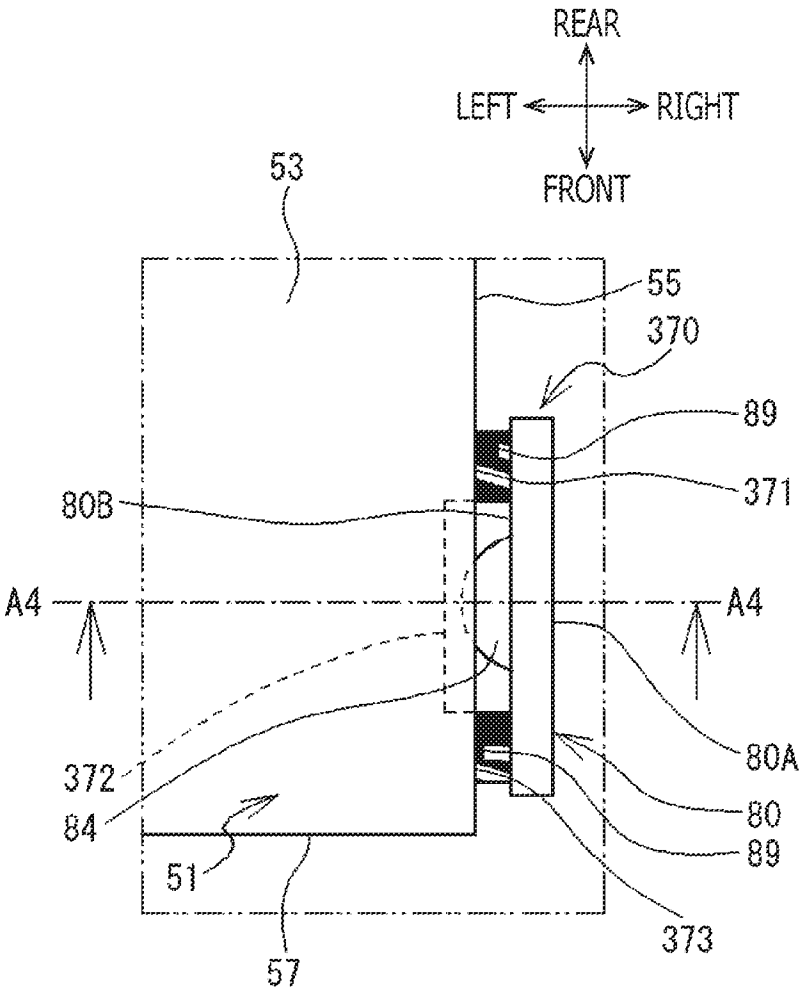

FIG. 10 is a plan view schematically showing a right front part of a tape cassette according to a third modification.

Figure 11:
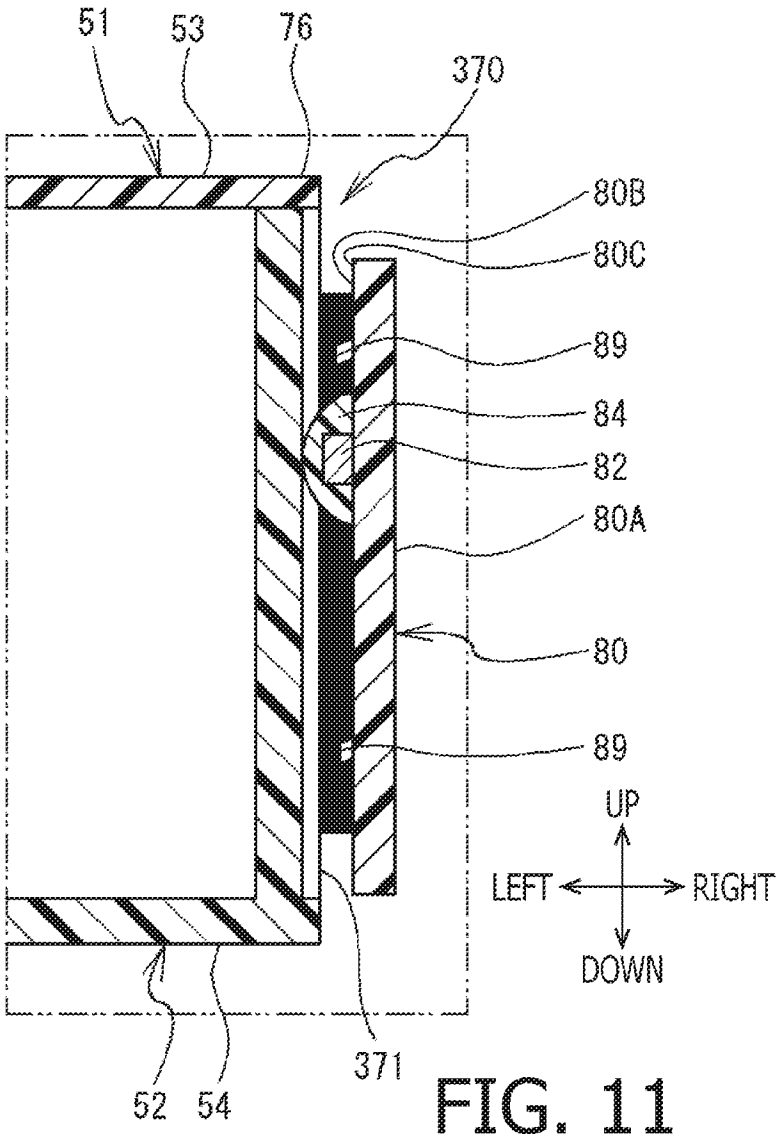

FIG. 11 schematically shows a cross-sectional view of the tape cassette taken along line A4-A4 and viewed from arrows shown in FIG. 10.

Figure 12:
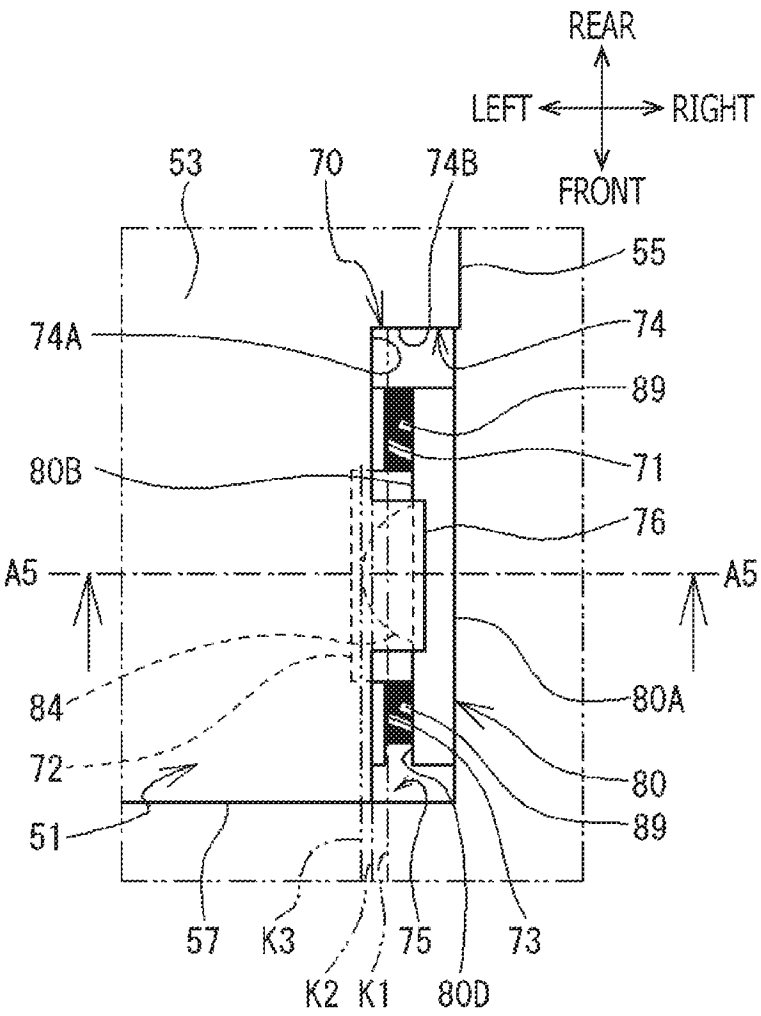

FIG. 12 is a plan view schematically showing a right front part of a tape cassette according to a fourth embodiment.

Figure 13:
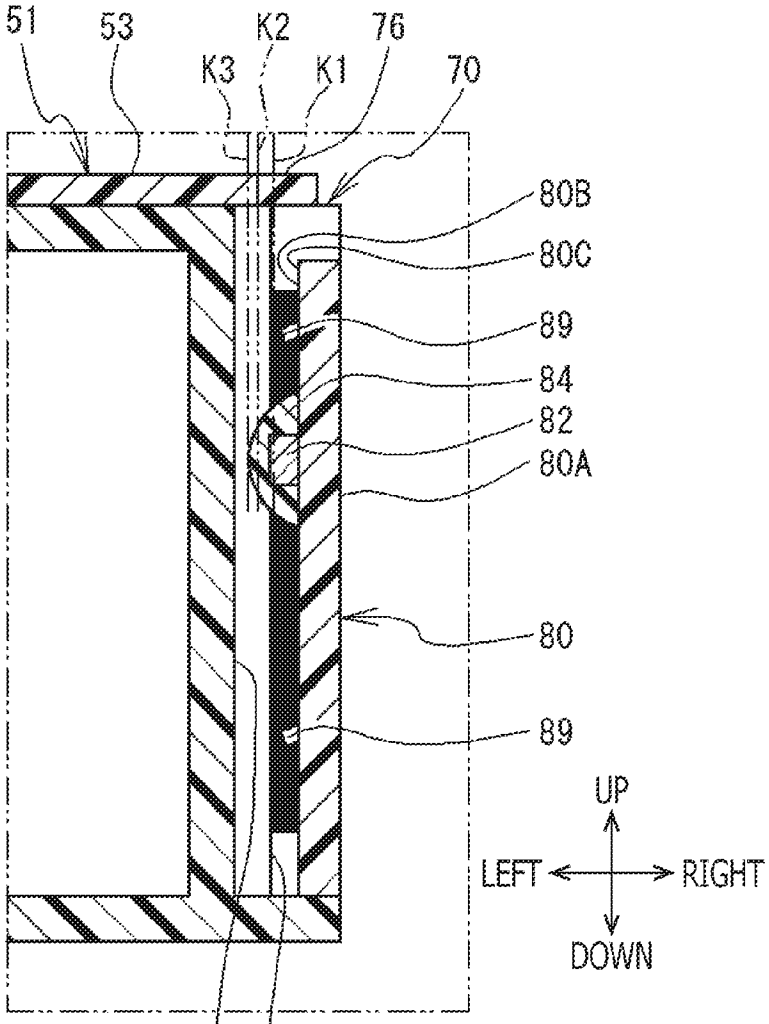

FIG. 13 schematically shows a cross-sectional view of the tape cassette taken along line A5-A5 and viewed from arrows shown in FIG. 12.

Figure 14:
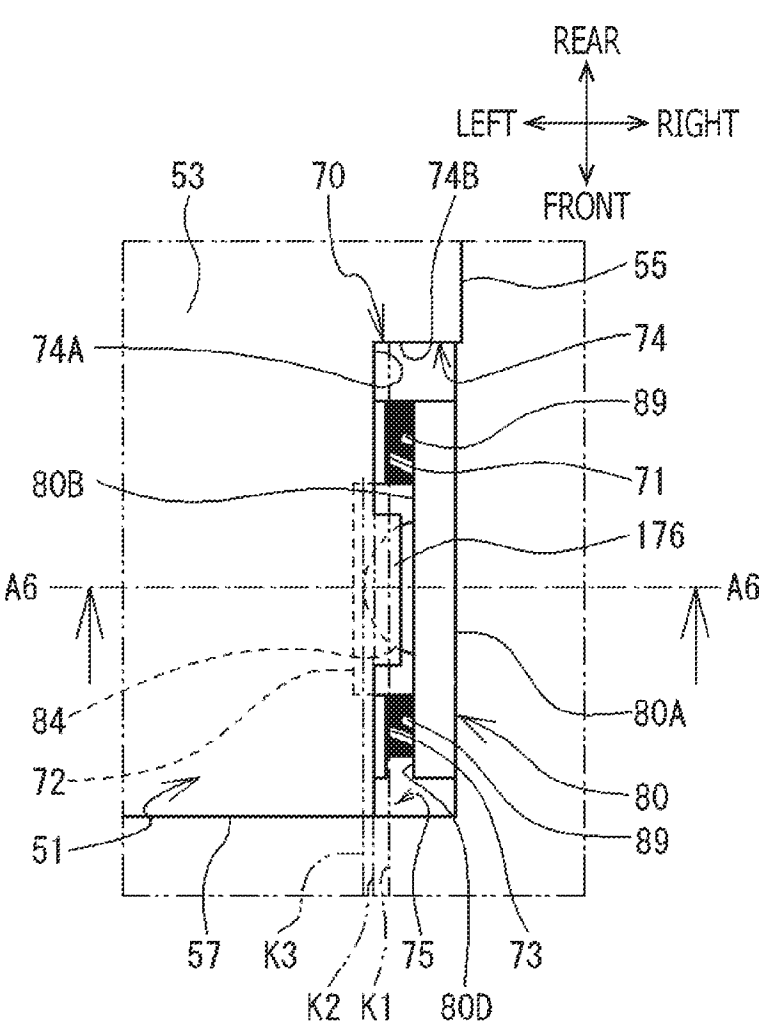

FIG. 14 is a plan view schematically showing a right front part of a tape cassette according to a fifth embodiment.

Figure 15:
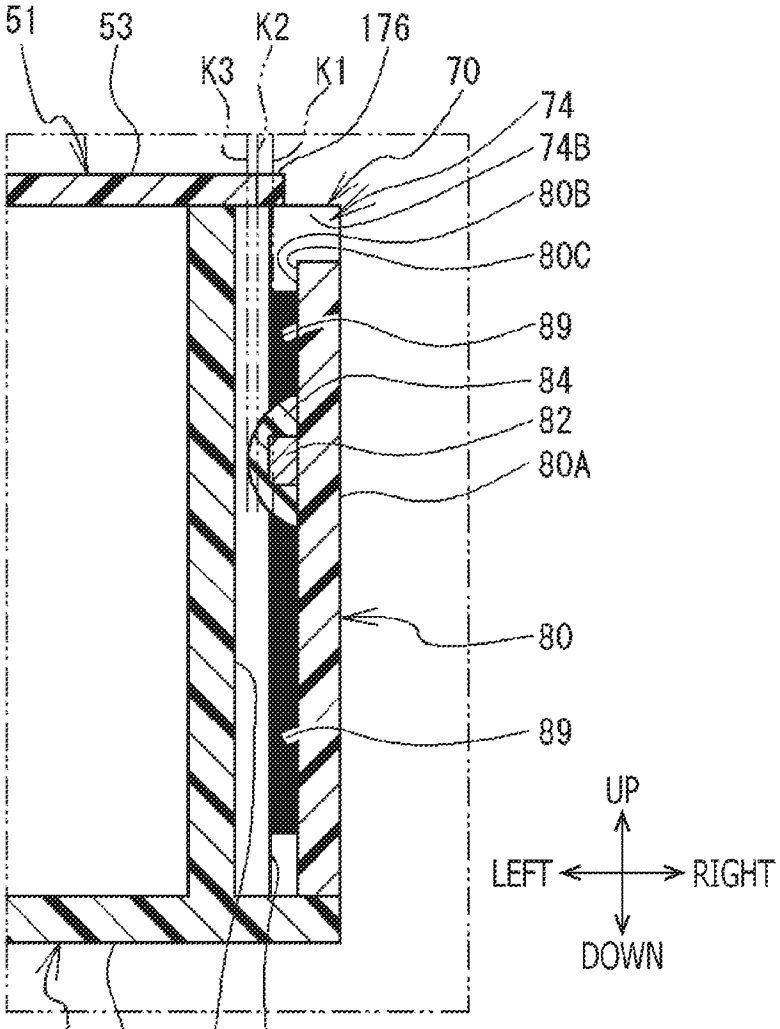

FIG. 15 schematically shows a cross-sectional view of the tape cassette taken along line A6-A6 and viewed from arrows shown in FIG. 14.

DESCRIPTION OF THE ILLUSTRATIVE EMBODIMENT

Hereinafter, an illustrative embodiment of the present disclosures will be described referring to the accompanying drawings. It is noted that the drawings referred to hereinafter are for illustrating technical characteristics which can be employed according to the aspects of the present disclosures. Configurations shown in the drawings are only examples and are not intended to limit the aspects of the present disclosures. It is noted that expressions "the same shapes" and "the same positions" in the following description are not intended to limit to "completely the same shapes" and "completely the same position," but are intended to include "substantially the same shapes" and "substantially the same positions," respectively. Similarly, the term "parallel" and "perpendicular (or orthogonal)" are not intended to limit to "accurately parallel" and "accurately perpendicular" but are intended to cover "substantially parallel" and "substantially perpendicular," respectively.

Further, a term "direction" may include both a one-way direction and an opposite-way (the other-way) direction (e.g., an up-down direction, a right-left direction), or may simply mean only a one-way direction (e.g., an upper direction, a right-hand direction). Hereinafter, when the term "direction" is used to have the latter meaning, a term "one-way" or "other-way" may occasionally be associated to emphasize that a particular direction (i.e., the "one-way" direction or the "other-way" direction) is referred to.

Firstly, an overall configuration of a tape cassette 1 according to an illustrative embodiment of the present disclosures will be described, referring to FIGS. 1 and 2. In the following description, an upper left side, a lower right side, a lower left side, an upper right side, an upper side and a lower side of FIG. 1 will be defined as a left side, a right side, a front side, a rear side, an upper side and a lower side of the tape cassette 1, respectively. According to the illustrative embodiment, the tape cassette 1 is employed by a printer (not shown) for printing.

By appropriately setting kinds of elongated tapes (e.g., a double-sided-adhesive tape 6, a film tape 7, a one-sided-adhesive tape, a heat-sensitive tape, a tube tape) and absence/presence of an ink ribbon 4 accommodated in a cassette case 50, the tape cassette 1 can be used as any of a laminate type cassette, a receptor type cassette, a thermal type cassette, and a tube type cassette. In the following description, a case where the tape cassette 1 is used as the laminated tape cassettes 5 will be described.

Figure 1:
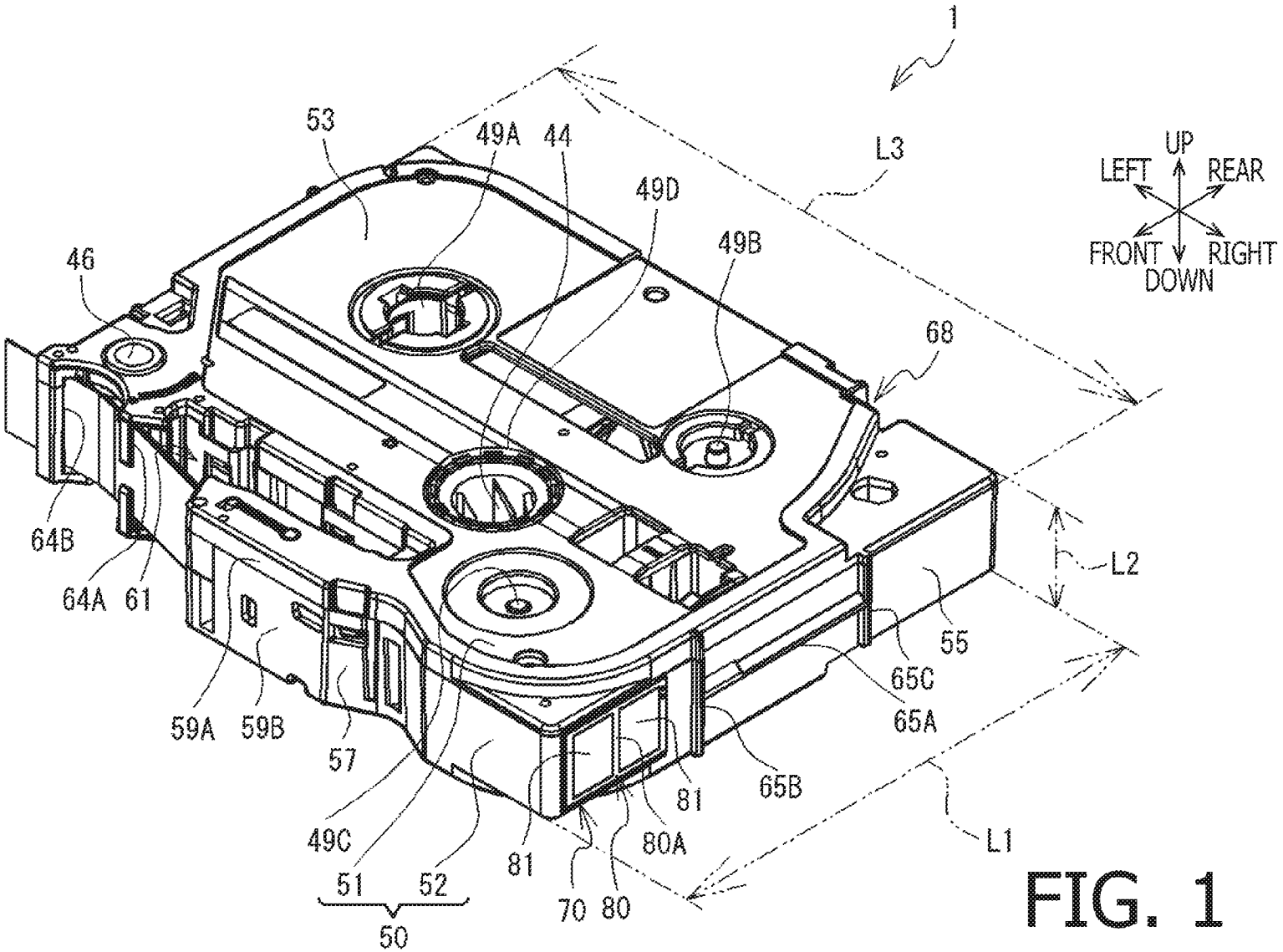
FIG. 1 is a perspective view of a tape cassette according to an illustrative embodiment viewed from an upper right front direction.

As shown in FIG. 1, the tape cassette 1 has a cassette case 50. The cassette case 50 has a substantially rectangular parallelepiped box shape, and has an upper case 51 and a lower case 52. The upper case 51 and the lower case 52 are arranged in the up-down direction, the upper case 51 being attached on the upper side of the lower case 51. The upper case 51 has an upper wall 53 and a peripheral wall 59A. The lower case 52 has a lower wall 54 (see FIG. 7A) and a peripheral wall 59B. Each of the upper wall 53 and the lower wall 54 extends in both the front-rear direction and the right-left direction. The lower wall 54 is arranged below the upper wall 53 with being aligned thereto.

The peripheral wall 59A extends downward from a periphery of the upper wall 53. The peripheral wall 59B extends upward from a periphery of the lower wall 54. The peripheral walls 59A and 59B form, in a state where the upper case 51 is coupled to the lower case 52, a right wall 55, a left wall 56, a front wall 57 and a rear wall 58 (see FIG. 7A). Each of the right wall 55 and the left wall 56 extends in both the front-rear direction and the up-down direction. The left wall 56 is arranged on the left side with respect to the right wall 55. Each of the front wall 57 and the rear wall 58 extends in both the up-down direction and the right-left direction. The rear wall 58 is arranged on the rear side with respect to the front wall 57.

The upper wall 53, the lower wall 54, the right wall 55, the left wall 56, the front wall 57 and the rear wall 58 are outer walls each facing outside the cassette case 50. A distance L1 between the front wall 56 and the rear wall 57 is larger than a distance L2 between the upper wall 53 and the lower wall 54. A distance L3 between the right wall 55 and the left wall 56 is larger than the distance L1 (see FIG. 1).

Figure 2:
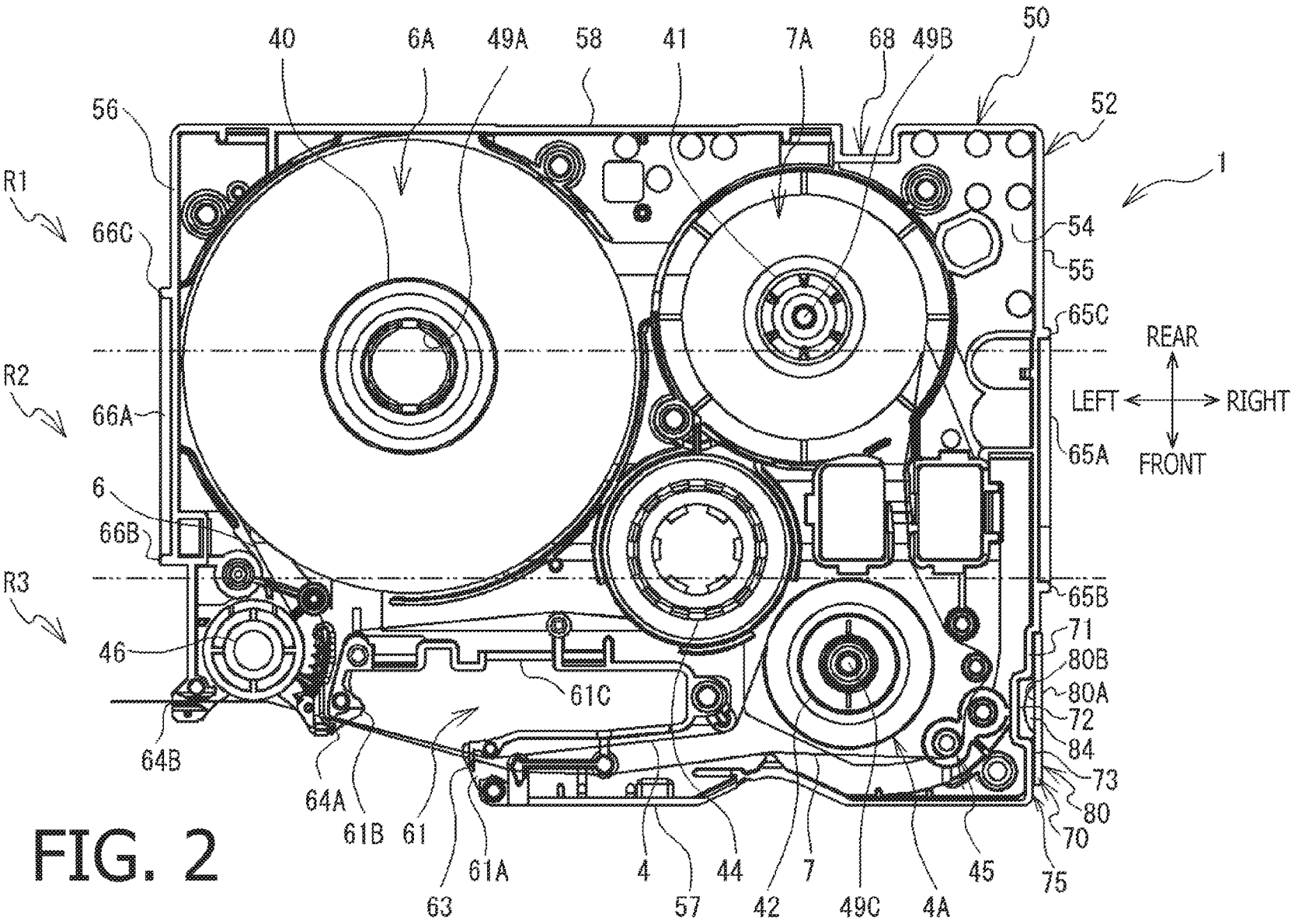
FIG. 2 is a plan view of a laminate type tape cassette with an upper case being removed.

As shown in FIG. 2, a head insertion part 61 is formed on the front wall 57. In the following description, three areas by evenly dividing the cassette case 50 in the front-rear direction will be referred to as a "first area R1," a "second area R2" and a "third area R3" from the rear side to the front side. The head insertion part 61 is arranged in the third area R3.

The head insertion part 61 is recessed rearward at the vicinity of a left end part of the front wall 57, and extends rightward. The head insertion part 61 penetrates through the cassette case 50 in the up-down direction. The head insertion part 61 includes a first side wall 61A, a second side wall 61B and a connection wall 61C. The first side wall 61A extends rearward from a portion on the slightly left side with respect to the central part in the right-left direction of the front wall 57, and faces leftward. The second side wall 61B extends rearward from a portion between, in plan view, the left wall 56 and the first side wall 61A, and faces rightward. The second side wall 61B is arranged on the left side with respect to the first side wall 61A. That is, a distance between the left side wall 56 and the second side wall 61B is smaller than a distance between the left wall 56 and the first side wall 61A.

The connection wall 61C extends, from a rear end portion of the first side wall 61A, rightward, rearward and then leftward so as to be connected to the rear end portion of the second side wall 61B.

On the first side wall 61A, a first discharging port 63 is formed. The first discharging port 63 is an opening extending in the up-down direction, and allows the film tape 7 and the ink ribbon 4 to be discharged from inside of the cassette case 50 to the outside thereof.

On the second wall 61B, an entering port 64A is formed. The entering port 64A is arranged on a downstream side, in a conveying direction of the film tape 7, with respect to the first discharging port 63 in the third area R3. The entering port 64A is an opening extending in the up-down direction, and guides the film tape 7 and the ink ribbon 4 discharged from the first discharging port 63 to enter the cassette case 50 with separating the film tape 7 and the ink ribbon 4 from each other. The film tape 7 and the ink ribbon 4 are accessible from outside at a portion between the first discharging port 63 and the entering port 64A. In a space surrounded by the head insertion part 61, the film tape 7 and the ink ribbon 4, the thermal head of the printing device 1 is inserted.

At the front end part of the left wall 56, a second discharging port 64B is formed. The second discharging port 64B is arranged on a downstream side, in the conveying direction of the film tape 7, with respect to the entering port 64A. The second discharging port 64B is an opening extending in the up-down direction, and the film tape 7 and the both-side adhesive tape 6, which are entered through the entering port 64 in a superimposed manner, are discharged outside through the second discharging port 64B.

As shown in FIGS. 1 and 2, an arrangement part 70 and ribs 65A, 65B and 65C are provided to the right wall 55. The arrangement part 70 is located within the third area R3. On the arrangement part 70, a substrate 80 is arranged.

The ribs 65A, 65B and 65C are formed at positions shifted rearward with respect to the substrate 80, and protrude outward from the cassette case 50, that is, ribs 65A, 65B and 65C are formed to protrude rightward from the right wall 55 to a right side with respect to the substrate 80. The rib 65A is formed to extend, at a central portion of the right wall 59 in the up-down direction, from the vicinity of a rear side of the arrangement part 70 to a rear side with respect to the central portion of the right wall 55 in the front-rear direction. The rib 65B is connected to a front end of the rib 65A, and extends in the up-down direction between the upper end and the lower end of the right wall 55. The rib 65C is connected to a rear end of the rib 65A, and extends in the up-down direction between the upper end and the lower end of the right wall 55.

As shown in FIG. 2, ribs 66A, 66B and 66C are provided on the left wall 56. The ribs 66A, 66B and 66C are formed at positions on the rear side with respect to the substrate 80, and protrude outward from the cassette case 50, that is, ribs 66A, 66B and 66C are formed to protrude leftward from the left wall 56 to a left side with respect to the substrate 80. The rib 66A extends in the right-left direction centering on a central position in the front-rear direction. The rib 66B is connected to a front end portion of the rib 66A and extends in the up-down direction between an upper end and a lower end of the left wall 56. The rib 66C is connected to a rear portion of the rib 66A and extends in the up-down direction between an upper and a lower end of the left wall 56.

On the rear wall 58, at a position on the right side with respect to a center, in the right-left direction, of the rear wall 58, a recess 68 is formed. The recess 68 is formed to be recessed frontward from the rear wall 58. The rear wall 58 has a planar surface except for the recess 68.

As shown in FIGS. 1 and 2, the cassette case 50 has a tape driving roller 46 and supporting parts 49A-49D. The tape driving roller 46 is a cylindrical member extending in the up-down direction between the upper wall 53 and the lower wall 54, and arranged at a left front corner of the cassette case 50. The tape driving roller 46 is rotatably supported by the upper wall 53 and the lower wall 54. The supporting part 49A is a cylindrical member extending in the up-down direction between the upper wall 53 and the lower wall 54. The supporting parts 49B and 49C are shaft members each extending in the up-down direction between the upper wall 53 and the lower wall 54. The supporting part 49D penetrates the upper wall 53 and the lower wall 54 in the up-down direction.

As shown in FIG. 2, the supporting part 49A is arranged on the oblique rear right side with respect to the tape driving roller 46, and rotatably supports a first tape spool 40. On the first tape spool 40, a first tape is wound. The supporting part 49B is arranged on the right side with respect to the supporting part 49A, and rotatably supports a second tape spool 41. On the second tape spool 41, a second tape is wound. The supporting part 49C is arranged on an oblique front right side with respect to the supporting part 49B, and rotatably supports a ribbon spool 42. On the ribbon spool 42, unused ink ribbon 4 is wound. The supporting part 49D is arranged on an oblique front right side with respect to the supporting part 49B, and rotatably supports a ribbon take-up spool 44. The used ink ribbon 4 is taken up by the ribbon take-up spool 44, and wound thereon.

In the laminate type tape cassette 1, the supporting part 49A supports the first tape spool 40 on which a both-side adhesive tape 6 is wound as a first tape (hereinafter, referred to as a both-side adhesive tape roll 6A). The supporting part 49B supports the second tape spool 41 on which a film tape 7 is wound as a second tape (hereinafter, referred to as a film tape roll 7A). The supporting part 49C supports the ribbon spool 42 on which an unused ink ribbon 4 is wound (hereinafter, referred to as an ink ribbon roll 4A).

The both-side adhesive tape roll 6A, the film tape roll 7A and the ink ribbon roll 4A are supplying sources of the both-side adhesive tape 6, the film tape 7 and the ink ribbon 4, respectively. The both-side adhesive tape roll 6A, the film tape roll 7A and the ink ribbon roll 4A are accommodated inside the cassette case 50 such that the width direction of the both-side adhesive tape 6, the film tape 7 and the ink ribbon 4 coincides with the up-down direction of the cassette case 50.

As shown in FIG. 2, on the right front side with respect to the ribbon roll 4A, a plurality of (four, according to the illustrative embodiment) bending pins 45 are arranged in the front-rear direction. Each of the plurality of bending pins 45 has a cylindrical shape extending in the up-down direction, and is fixed to the lower wall 54. The plurality of bending pins 45 define a passage of the film tape 7. That is, the passage of the film tape 7 extends frontward from the film roll 7A, turns leftward via the plurality of bending pins 45, passes through the first discharging port 63, and reaches the second discharging port 64B.

Referring to FIG. 1 through FIG. 5, the substrate 80 and the arrangement part 70 will be described. As shown in FIG. 1, the substrate 80 has a rectangular shape having longer sides and shorter sides. Further, the substrate 80 has a first surface 80A and a second surface 80B (see FIG. 3). The first surface 80 and the second surface 80 respectively face opposite sides. On the first surface 80A, a pair of (i.e., two)

conductive electrodes 81 are provided. Each of the two conductive electrodes 81 is a metallic electrode. The two conductive electrodes 81 are arranged in a longer side direction (hereinafter, referred to as a Y1 direction: see FIG. 3) of the substrate 80 with a particular clearance therebetween. Each of the two conductive electrodes 81 has a rectangular shape elongated in a shorter side direction (hereinafter, referred to as a Y2 direction: see FIG. 3) of the substrate 80. The two conductive electrodes 81 have the same shapes. One side ends, in the Y2 direction (e.g., the upper side in FIG. 3), of the two conductive electrodes 81 are located at the same positions in the Y2 direction. Further, the other side ends, in the Y2 direction (e.g., the lower side in FIG. 3), of the two conductive electrodes 81 are located at the same positions in the Y2 direction.

Figure 3:
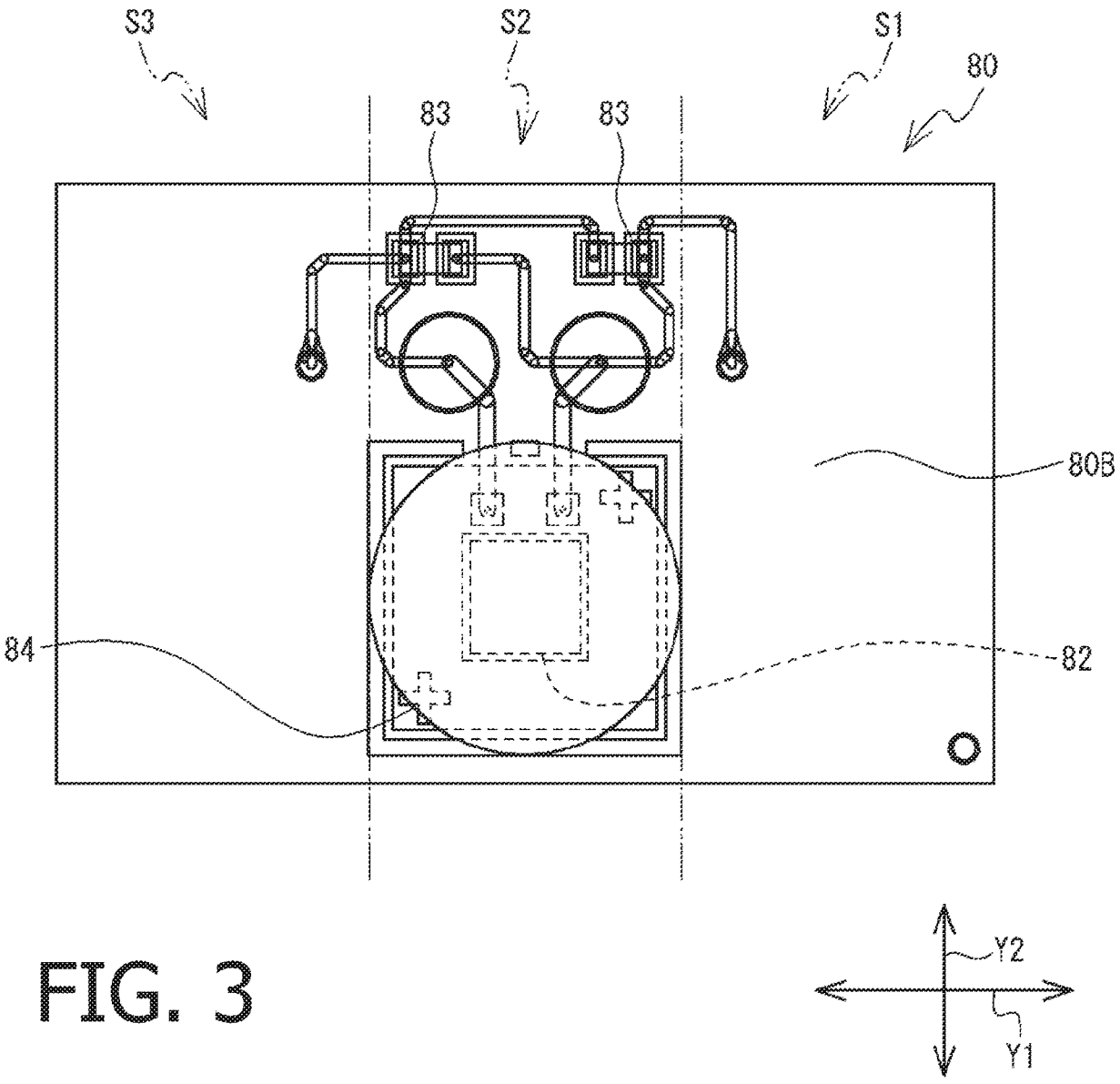
FIG. 3 shows a substrate viewed from a second surface side thereof.

As shown in FIG. 3, an IC chip 82, two condensers 83 and a molded part 84 are provided on the second surface 80B. The IC chip 82 is electrically connected to the two conductive electrodes 81 via the two condensers 83, respectively. The IC chip 82 is configured to store various pieces of information such as information of the type of the tape cassette 1 (e.g., the laminate type), information of the type of the tape (e.g., the color, the width) and the like. The two condensers 83 are connected to pass electric signals having a particular frequency. The molded part 84 is a resin member covering the IC chip 82 to protect the same.

In the following description, a right-hand side of FIG. 3 will be referred to as a "one-way side" in the Y1 direction, and a left-hand side of FIG. 3 will be referred to as the "other-way side" in the Y1 direction. Further, the second surface 80B is equally divided into three areas in the Y1 direction and the three divided areas will be referred to as "a first substrate area S1," "a second substrate area S2" and "a third substrate area S3" in this order from one side (i.e., the right-hand side in FIG. 3) to the other side (i.e., the left-hand side in FIG. 3) in the Y1 direction. As shown in FIG. 3, the IC chip 82, the condensers 83 and the molded part 84 are all arranged within the second substrate area S2.

As shown in FIG. 2, the arrangement part 70 is recessed leftward from the right wall 55. The arrangement part 70 is arranged on the right wall 55 at a position adjacent to the front wall 57. A portion in the vicinity of the front end part of the arrangement part 70 overlaps the second discharging port 64B when viewed in the right-left direction.

The arrangement part 70 includes a first wall 71, a relief recess 72 and a second wall 73. The first wall 71 and the second wall 73 are arranged in the front-rear direction with the relief recess 72 arranged therebetween. The first wall 71, the relief recess 72 and the second wall 73 are arranged in this order from the rear side to the front side, and form a bottom wall of the arrangement part 70. The first wall 71 and the second wall 73 are arranged on the left side with respect to the right wall 55, and extends in a direction perpendicular to the right-left direction. The relief recess 72 is arranged in the third area R3 and recessed leftward from the first wall 71 and the second wall 73. The relief recess 72 extends in the up-down direction. that is, the extending direction of the relief recess 72 is the up-down direction. A part of the relief recess overlaps the second discharging port 64B viewed in the right-left direction.

As shown in FIGS. 4 and 5, opening parts 74 and 75 are provided to an upper end part and a front end part of the arrangement part 70, respectively. The opening part 74 includes an opening walls 74A and 74B. the opening wall 74A extends rearward from the upper end part of the front wall 57, and is directed rightward. The opening wall 74B extends rightward from the rear end part of the opening wall 74A to the right wall 55, and is directed frontward.

A phantom line K1 extends in the front-rear direction, passing through the first wall 71 and the second wall 73. The phantom line K1 indicates a position, in the right-left direction, of the first wall 71 and the second wall 73. A phantom line K2 extends in the front-rear direction, passing the opening wall 74A. The phantom line K2 indicates a position, in the right-left direction, of the opening wall 74A. A phantom line K3 extends in the front-rear direction, passing a left end part of the molded part 84. The phantom line K3 indicates a position, in the right-left direction, of the left end part of the molded part 84.

The phantom line K2 is arranged on the left side with respect to the phantom line K1, and the phantom line K3 is arranged on the left side with respect to the phantom line K2.

As shown in FIG. 2, the substrate 80 is arranged at the arrangement part 70 in a state where the Y1 direction (see FIG. 3) is parallel to the front-rear direction of the tape cassette 1, and the first surface 80A is directed rightward. It is noted that the substrate 80 can be arranged to the arrangement part 70 regardless of whether the one-way side of the Y1 direction (i.e., the right-hand side in FIG. 3) is directed to the rear side or front side of the tape cassette 1.

Hereinafter, description will be made based on a case where the substrate 80 is arranged at the arrangement part 70. As shown in FIGS. 3 and 4, between the first wall 71 and the second surface 80B, and between the second wall 73 and the second surface 80B, adhesive layers 89 are arranged. It is noted that the adhesive layer 89 is not provided at the upper end part 80C and the front end part 80D of the second surface 80B. That is, the adhesive layers 89 are provided to portions different from the opening parts 74 and 75 sides (i.e., portions other than the upper end part 80C and the front end portions 80D) of the second surface 80B. According to the illustrative embodiment, the adhesive layer 89 is the both-side adhesive tape, which has a base material and the adhesive layer. The base material has a belt-like shape (i.e., an elongated rectangular shape). The adhesive layers are formed on both sides of the base material. The base material has an elongated rectangular shape. The adhesive layers are formed on both sides of the base member. The substrate 80 is arranged to be bridged on the first wall 71 and the second wall 73 with sandwiching the adhesive layer 89 between the substrate 80 and each of the first wall 71 and the second wall 73. Since the adhesive layer 80 does not exist at the upper end part 80C and the front end part 80D, a clearance is formed between the second surface 80B and each of the first wall 71 and the second wall 73. The molded part 84 and the IC chip 82 are arranged at the relief recess 72. The first wall 71 and the second wall 72 extend in parallel with the second surface 80B. The right wall 55 and the first surface 80A are arranged at the same position in the right-left direction.

Since the phantom line K2 is arranged on the left side with respect to the phantom line K1, all the upper end part, in the right-left direction, of the adhesive layer 89 protrudes upward through the opening part 74, and all the front end part, in the right-left direction, of the adhesive layer 89 protrudes front ward through the opening part 75. Since the phantom line K3 is arranged on the left side with respect to the phantom line K2, the left end part of the molded part 84 overlaps the upper case 51 in the up-down direction. That is, the upper wall 53 covers only the left end part of the molded part 84 from the above.

The entire substrate 80 is arranged, in a side view, within a rectangular area surrounded by peripheral parts of the right wall 55 (see FIG. 1). That is, the substrate 80 does not protrude outward, in the side view, from the peripheral parts of the right wall 55.

As shown in FIG. 2, the substrate 80 is arranged within the third area R3. The center of the substrate 80, in the front-rear direction, is on the front side with respect to the center of the second discharging port 64B in the front-rear direction. A part of the substrate 80 overlaps the second discharging port 64B in the right-left direction. Specifically, the front side conductive electrode 81 of the pair of conductive electrodes 81 overlaps the second discharging port 64B when viewed in the right-left direction.

As aforementioned, the front wall 57 and the rear wall 58 are aligned in the front-rear direction. Since the head insertion part 61 is provided to the front wall 57, the worker can securely hold the cassette case 50 by, for example, holding the head insertion part 61 and the rear wall 58. Further, since the arrangement part 70 is provided to the right wall 55, and the adhesive layer 89 is accessible from outside the cassette case 50 through the opening parts 74 and 75, the worker can visually recognize the adhesive layer 89 easily with holding the head insertion part 61 and the rear wall 58. Thus, when a tool (e.g., a flat-blade screwdriver) is inserted, through the opening parts 74 and 75, to the adhesive layer 89, the worker can easily remove the substrate 80 from the arrangement part 70 without touching the molded part 84. Therefore, according to the tape cassette 1, the worker can remove the substrate 80 easily from the arrangement part 70, with suppressing the IC chip 82 from being damaged when the substrate 80 is removed from the arrangement part 70.

The rear wall 58 has a planar surface except for the recess 68. Therefore, the worker can securely hold the cassette case 50 by sliding fingers along the planer surface different from the recess 68 of the rear wall 58. Thus, according to the tape cassette 1, in comparison with a case where a portion along which the worker can slide the fingers is not provided on the rear wall 58, the worker can advance an operation to remove the substrate 80 from the arrangement part 70 smoothly.

There could be a case where the worker moves the thumb along the rear wall 58, while hooks another finger on the head insertion part 61 to hold the cassette case 50, and performs an operation to remove the substrate 80 from the arrangement part 70. In such a case, since the head insertion part 61 and the arrangement part 70 are arranged within the third area R3, the substrate 80 is located at a position spaced from the thumb of the worker. Thus, it is suppressed that the worker's sight directed to the substrate 80 is block by the thumb of the worker. Therefore, according to the tape cassette 1, a worker's operation to remove the substrate 80 from the arrangement part 70 can be performed smoothly.

The arrangement part 70 is recessed leftward from the right wall 55, and the substrate 80 is arranged at the arrangement part 70. According to this configuration, a protruding amount of the substrate 80 on the right side with respect to the right wall 55 is smaller in comparison with a case where the arrangement part 70 is not recessed leftward from the right wall 55. According to the illustrative embodiment, since the right wall 55 and the first surface 80A are arranged at the same positions in the right-left direction, the substrate 80 does not protrude rightward with respect to the right wall 55. Therefore, the substrate 80 is suppressed from being removed from the arrangement part 70 when the tape cassette 1 is normally used. On the upper end part and the front end part of the arrangement part 70, the opening parts 74 and 75 are formed, and the adhesive layer 89 is accessible from the upper side and the front side through the openings 74 and 75, respectively. Accordingly, the worker can insert a tool to the adhesive layer 89 through the opening part 74 or 75. Thus, according to the tape cassette 1 configured as above, inadvertent removal of the substrate 80 from the arrangement part 70 during the normal usage of the tape cassette 1 is suppressed, while the worker is enabled to remove the substrate 80 easily from the arrangement part 70 when the worker intentionally removes the substrate 80.

The substrate 80 is a rectangular shape having a longer side in the Y1 direction. The substrate 80 is attached to the attachment part 70 such that the Y1 direction coincides with the front-rear direction. In the arranged state, the opening part 74 is located at the upper end part of the arrangement part 70, that is, on one side in the Y2 direction. When, for example, the tool is inserted in the adhesive layer 89 through the opening part 74 to remove the substrate 80 from the arrangement part 70, an end part of the substrate 80 on a side opposite to the opening part 74 serves as a fulcrum. In such a case, since a distance between the fulcrum and the tool (i.e., the point of effort) is smaller, in comparison with a case where the tool is inserted in the adhesive layer 89 through the opening part 75 to remove the substrate 80 from the arrangement part 70, the load to be applied to the substrate 80 when removing the substrate 80 from the arrangement part 70 is suppressed according to the tape cassette 1.

The opening part 75 is provided at the front end part of the arrangement pat 70, that is, on one side of the Y1 direction. When, for example, the tool is inserted into the adhesive layer 89 through the opening part 75 to remove the substrate 80 from the attachment part 70, an end part of the substrate 80 on a side opposite to the opening part 75 serves as a fulcrum. In this case, since a distance between the fulcrum and the tool (i.e., the point of effort) is larger, in comparison with a case where the tool is inserted to the adhesive layer 89 through the opening part 74 to remove the substrate 80 from the arrangement part 70, the worker can gradually remove the substrate 80 from the arrangement part 70. Thus, according to the tape cassette 1, a situation where the worker inadvertently drops the substrate 80 due to abrupt removal of the substrate 80 from the arrangement part 70 when the worker has completed removal of the substrate 80 from the arrangement part 70 can be suppressed.

When, for example, the tool is inserted to the adhesive layer 89 through the opening part 75 to remove the substrate 80 from the attachment part 70, an end part of the substrate 80 on a side opposite to the opening part 75 serves as a fulcrum. When the substrate 80 rotates, about the fulcrum, in a direction where the substrate 80 is spaced from the arrangement part 70, a motion locus of the molded part 84 forms an arc viewed along the front-rear direction. If the relief recess 72 extends in parallel with a direction in which the fulcrum extends, a side wall of the relief recess 72 exists on the motion locus of the molded part 84 in side view. In such a case, there is a possibility that the molded part 84 contacts the side wall of the relief recess 72 when the substrate 80 is removed from the attachment part 70. According to the illustrative embodiment, the opening part 74 is provided to the upper end part of the arrangement part 70, that is, at one end portion of the extending direction (i.e., the up-down direction) of the relief recess 72. Therefore, an end part of the substrate 80 opposite to the opening part 75 (i.e., the fulcrum) extends in a direction perpendicular to the extending direction of the relief recess 72. In this case, since the side wall of the relief recess 72 extends along the motion locus of the molded part 84 in side view, the side wall of the relief recess 72 does not exist on the motion locus of the molded part 84. Therefore, the tape cassette 1 can suppress the molded part 84 from contacting the relief recess 72 when the substrate 80 rotates, about the fulcrum, in the direction where the substrate 80 is separated from the arrangement part 70.

Since the relief recess 72 extends in the up-down direction, the adhesive layer 89 is divided, by the relief recess 72, in a width direction (i.e., the front-rear direction) perpendicular to the extending direction of the relief recess 72, but not divided in a direction in parallel with the extending direction of relief recess 72 (i.e., the up-down direction). There could be a case where, for example, the worker may insert a cutter in the adhesive layer 89 through the opening part 75, and cut the adhesive layer 89 by reciprocally moving the cutter in the front-rear direction. In such a case, since the opening part 75 is provided to a front end part of the attachment part 70, that is one side part in a direction perpendicular to the extending direction of the relief recess 72 (i.e., the front-rear direction), a portion of the adhesive layer 89 accessible from outside through the opening part 75 is not divided thereby. Accordingly, the worker can continuously and reciprocally move the cutter in the up-down direction with respect to the adhesive layer 89. Thus, according to the tape cassette 1, the substrate 80 can be removed from the attachment part 70 easily.

The phantom line K2 is arranged on the left side with respect to the phantom line K1. That is, the opening wall 74A is arranged on the left side with respect to the first wall 71 and the second wall 73. Because of this configuration, since the entire upper end part, in the right-left direction, of the adhesive layer 89 is accessible from the upper side through the opening part 74, the worker can visually recognize the adhesive layer 89 through the opening part 74 easily. Therefore, when the worker inserts the tool in the adhesive layer 89, the tool is suppressed from contacting the molded part 84 according to the tape cassette 1 configured as above.

The right wall 55 and the left wall 56 are aligned in the right-left direction. The second discharging port 64B is provided to the left wall 56 and the arrangement part 70 is provided to the right wall 55. Therefore, the tape is discharged, through the second discharging port 64B, toward a side opposite to the arrangement part 70. With this configuration, when the worker removes the substrate 80 from the attachment part 70, blocking of the worker's eye line directed to the arrangement part 70 by the tape is suppressed. Accordingly, an operation to remove the substrate 80 from the attachment part 70 can be performed smoothly.

The upper end part 80C and the front end part 80D of the substrate 80 on the opening parts 74 and 75 sides, the adhesive layer 89 is not provided. Therefore, at the positions of the upper end part 80C and the front end part 80D, a clearance is formed between each of the first wall 71 and the second wall 73 and the substrate 80. Therefore, the worker can insert the tool into the clearances through the opening parts 74 and 75, respectively. Thus, the worker can remove the substrate 80 from the attachment part 70 easily according to the tape cassette 1.

When the worker removes the substrate 80 from the attachment part 70, since the adhesive layer 89 is composed of the both-side adhesive tape, the stress applied to the substrate 80 is buffered by the base material of the both-side adhesive tape. Therefore, in comparison with a case where adhesive agent is employed as the adhesive layer 89, the load to the substrate 80 when removed from the attachment part 70 can be suppressed according to the tape cassette 1.

The first wall 71 and the second wall 73 are arranged in the front-rear direction with the relief recess 72 located therebetween. According to this configuration, the substrate 80 is adhered to the first wall 71 and the second wall 73 in a bridging manner such that both end parts, in the Y1 direction, of the substrate 80 is adhered on the first wall 71 and the second wall 73, respectively. According to this configuration, in comparison with a case where only one of the front end part and the rear end part of the substrate 80 is adhered to the arrangement part 70, the substrate 80 is stably adhered onto the arrangement part 70.

Therefore, according to the tape cassette 1, the substrate 80 is suppressed from removed on its own from the attachment part 70 when the tape cassette 1 is being normally used. Since adhering portions between the first wall 71 and the substrate 80, and between the second wall 71 and the substrate 80 are divided into two portions, the worker can remove the substrate 80 from the attachment part 70 by inserting the tool to one portion after another. Therefore, if an accessible area is the same, the worker can remove the substrate 80 from the attachment part 70 of the tape cassette 1 more easily than a configuration where the adhered position is concentrated to one side.

Since the first wall 71 and the second wall 73 extend in parallel with the second surface 80B, a clearance is hardly formed between the substrate 80 and each of the first wall 71 and the second wall 73. Therefore, in comparison with a case where a clearance is formed between the substrate 80 and each of the first wall 71 and the second wall 73, adhesion of the substrate 80 with respect to the arrangement part 70 is stabilized. Therefore, according to the tape cassette 1, removal of the substrate 80 on its own from the arrangement part 70 can be suppressed when the tape cassette 1 is being used normally.

Since the substrate 80 is entirely arranged within the rectangular area surrounded by the periphery of the right wall 55 in side view, the substrate 80 does not protrude outward from the periphery of the right wall 55. Therefore, in comparison with a case where the substrate 80 protrudes outward from the rectangular area surrounded by the periphery of the right wall 55 in side view, the substrate 80 is suppressed from being caught and removed from the attachment part 70 when the tape cassette 1 is being used normally.

It is noted that he upper wall 53 is an example of a first outer wall according to aspects of the disclosures. The lower wall 54 is an example of a second outer wall according to aspects of the disclosures. The right wall 55 is an example of a third outer wall according to aspects of the disclosures. The left wall 56 is an example of a fourth outer wall according to aspects of the disclosures. The front wall 57 is an example of a fifth outer wall according to aspects of the disclosures. The rear wall 58 is an example of a sixth wall according to aspects of the disclosures. The up-down direction of the tape cassette 1 is an example of a first direction f according to aspects of the disclosures. The right-left direction of the tape cassette 1 is an example of a second direction according to aspects of the disclosures. The front-rear direction of the tape cassette 1 is an example of a third direction according to aspects of the disclosures. The film tape 7 is an example of a tape according to aspects of the disclosures. The IC chip 82 is an example of a storage according to aspects of the disclosures. The left side of the tape cassette 1 is an example of a fourth direction according to aspects of the disclosures. The first wall 71 and the second wall 73 are examples of a bottom wall according to aspects of the disclosures. The arrangement part 70 is an example of a first concave part according to aspects of the disclosures. The relief part 72 is a second concave part according to aspects of the disclosures. The upper case 51 is an example of a first case according to aspects of the disclosures. The lower case 52 is an example of a second case according to aspects of the disclosures. The second discharging port 64B is an example of a discharging port according to aspects of the disclosures. The first wall 71 is a first bottom wall according to aspects of the disclosures. The second wall 73 is an example of a second bottom wall according to aspects of the disclosures. The head insertion part 61 is a particular concave part according to aspects of the disclosures. The opening parts 74 and 75 are examples of an opening part according to aspects of the disclosures. The opening wall 74A is an example of an opening wall according to aspects of the disclosures. The supporting part 49B is an example of a supporting part according to aspects of the disclosures. The film roll 7A is an example of a tape roll according to aspects of the disclosures.

The illustrative embodiment described above can be modified in various ways without departing from the aspects of the present disclosures.

Referring to FIGS. 6 and 7, a first modified embodiment according to the present disclosures will be described. In the following description, configurations common with the above-described illustrative embodiment will be assigned with the same reference numbers, and description thereof will be omitted, while configurations different from the above-described embodiment will be mainly described.

The first modified embodiment is different from the above-described embodiment in that an opening part 174 is provided to the arrangement part 70 instead of the opening part 74 according to the illustrative embodiment. The opening part 174 has opening walls 174A and 174B. The opening wall 174A extends, from the upper end part of the front wall 57, downward and rearward, and is directed rightward. The opening wall 174B extends rightward from the rear end of the opening wall 174A to the right wall 55, and is directed frontward. The first modified embodiment is further different from the above-described embodiment in that the length in the right-left direction of the opening wall 174B is shorter than the length of the opening wall 74B in the right-left direction.

Phantom lines K11 and K13 respectively correspond to the phantom lines K1 and K3 of the above-described embodiment. The phantom line K12 extends in the front-rear direction, passing through the opening wall 174A. That is, the phantom line K12 indicates a position, in the right-left direction, of the opening wall 174A.

According to the first modified embodiment, the phantom line K12 coincides with the phantom line K11. That is, the position of the opening wall 174A with respect to the first wall 71 and the second wall 73 according to the first modified embodiment is different from the position of the opening wall 74A with respect to the first wall 71 and the second wall 73 in the above-described embodiment. The phantom line K13 is arranged on the left side with respect to the phantom lines K11 and K12. Therefore, a left side portion of the molded part 84 overlaps the upper case 51 in the up-down direction. That is, the upper wall 53 covers a left side portion of the molded part 84 from the above. According to the first modified embodiment, since the opening wall 174A is arranged on a slightly right side in comparison with the opening wall 74A of the above-described embodiment, the upper wall 53 can cover a relatively larger portion, in the plan view, of the molded part 84 in comparison with the above-described embodiment.

According to the first modified embodiment, the phantom line K12 coincides with the phantom line K11. Accordingly, the opening wall 174A is on the same plane of the first wall 71 and the second wall 73. With this configuration, in comparison with a case where there are steps between the first wall 71 and the opening wall 74A, and between the second wall 73 and the opening wall 74A, a relatively large space for allowing the tool to be slid can be secured. Therefore, when the worker removes the substrate 80 from the arrangement part 70 by sliding the tool, the worker can handle the tool easily. Thus, according to the tape cassette 1, the worker can easily remove the substrate 80 from the arrangement part 70.

Referring to FIGS. 8 and 9, a second modified embodiment will be described. In the following description, the configurations same as those of the above-described embodiment are assigned with the same reference numbers, and description thereof will be omitted. Configurations different from those in the above-described embodiment and the first modified embodiment will be mainly described.

The second modified embodiment is different from the above-described embodiment in that an opening part 274 is provided to the arrangement part 70 instead of the opening part 74. The opening part 274 has opening walls 274A and 274B. The opening wall 274A extends downward and rearward from the upper end part of the front wall 57, and is directed rightward. The opening wall 274B extends rightward from the rear end part of the opening wall 274A to the right wall 55, and is directed frontward. The second modified embodiment is different from the above-described embodiment and the first modified embodiment in that a length, in the right-left direction, of the opening wall 274B is shorter than the length, in the right-left direction, of the opening wall 74B of the above-described embodiment, or the length, in the right-left direction, of the opening wall 174B of the first modified embodiment.

Phantom lines K21 and K23 respectively correspond to the phantom lines K1 and K3 according to the above-described embodiment. The phantom line K22 extends in the front-rear direction, passing through the opening wall 274A. That is, the phantom line K22 indicates a position of the opening wall 274A in the right-left direction.

According to the second modified embodiment, the phantom line K22 is arranged on the right side with respect to the phantom line K21. That is, a position of the opening wall 274A, in the right-left direction, with respect to the first wall 71 and the second wall 73 is different from the position of the opening wall 74A, in the right-left direction, with respect to the first wall 71 and the second wall 73 according to the illustrative embodiment, or a position of the opening wall 174A, in the right-left direction, with respect to the first wall 71 and the second wall 73 according to the first modified embodiment. The phantom line K23 is arrange on the left side with respect to the phantom lines K21 and K22. Accordingly, a left part of the molded part 84 overlaps the upper case 51 in the up-down direction. That is, the upper wall 53 covers the left part of the molded part 84 from the above.

According to the second modified embodiment, as the opening wall 274A is arranged on a further right side than the opening wall 74A according to the illustrative embodiment, the upper wall 53 can cover a more area, in the plan view, of the molded part 84 from the above in comparison with the configuration according to the illustrative embodiment. Further, as the opening wall 274A is arranged on a further right side than the opening wall 174A according to the first modified embodiment, the upper wall 53 can cover a more area, in the plan view, of the molded part 84 from the above in comparison with the configuration according to the first modified embodiment.

According to the second modified embodiment, the phantom line K22 is arranged on the right side with respect to the phantom line K21. That is, the opening wall 274A is arranged on the right side with respect to the first wall 71 and the second wall 73. Therefore, when the worker inserts the tool in the adhesive layer 89 through the opening part 274 to remove the substrate 80 from the arrangement part 70, the opening wall 274A serves as the fulcrum. Accordingly, the worker can remove the substrate 80 from the arrangement part 70 making use of the principle of leverage. Thus, according to the tape cassette 1, the load to the worker when the substrate 80 is removed from the attachment part 70 can be reduced.

Next, referring to FIGS. 10 and 11, a third modified embodiment according to aspects of the present disclosures will be described. In the following description, configurations same as those of the above-described embodiment will be assigned with the same reference numbers and description thereof will be omitted. Portions different from the above-described embodiment will be mainly described. It is noted that the third modification can also be applied to the first modified embodiment or the second modified embodiment.

According to the third embodiment, an arrangement part 370 is provided to the right wall 55 instead of the arrangement part 70. The arrangement part 370 is provided within the third area R3. The substrate 80 is arranged at the arrangement part 370. The arrangement part 370 is formed on the same plane of the right wall 55. That is, unlike the arrangement part 70 according to the illustrative embodiment, the arrangement part 370 is not recessed leftward from the right wall 55. The arrangement part 370 is arranged on the right wall 55 at a position adjacent to the front wall 57. The vicinity of a front end part of the arrangement part 370 overlaps the second discharging port 64B in the right-left direction.

The arrangement part 370 includes a first wall 371, a relief recess 372 and a second wall 373. The first wall 371 and the second wall 373 are arranged in the front-rear direction with the relief recess 372 being arranged therebetween. The first wall 371, the relief recess 372 and the second wall 373 are arranged from the rear side to the front side in this order. The first wall 371 and the second wall 373 are arranged at a position the same as a position of the right wall 55 in the right-left direction, and both the first wall 371 and the second wall 373 extend perpendicularly to the right-left direction. The relief recess 372 is arranged within the second area R3, and is recessed leftward from the first wall 371 and from the second wall 373. The relief recess 372 extends in the up-down direction. A part of the relief recess 372 overlaps the second discharging port 64B in the right-left direction.

The substrate 80 arranged at the arrangement part 370 with the Y1 direction (see FIG. 3) being in parallel with the front-rear direction of the tape cassette 1, and with the first surface 80A being directed rightward. The substrate 80 is configured to be arranged at the arrangement part 370 regardless of wither a one side of the Y1 direction (e.g., the right side in FIG. 3) is directed to the rear side or the front side of the tape cassette 1.

Between each of the first wall 371 and the second wall 373, and the second surface 80B, the adhesive layer 89 is arranged. At the periphery of the second surface 80B, the adhesive layer 89 is not provided. That is, the adhesive layer 89 is provided to a portion of the second surface 80B other than the periphery of the second surface 80B. The substrate 80 is arranged to be bridged between the first wall 371 and the second wall 373 with the adhesive layer 89 located between the substrate 80 and each of the first wall 371 and the second wall 373. The molded part 84 and the IC chip 82 are arranged at the relief recess 372. Each of the first wall 371 and the second wall 373 extends in parallel with the second surface 80B. the right wall 55 and the first surface 80A are arranged at the same position in the right-left direction.

According to the third modified embodiment, since the first wall 371 and the second wall 373 are arranged on the same plane of the right wall 55, the adhesive layer 89 is accessible from the upper side, the lower side, the front side and the rear side. Therefore, when the worker remove the substrate 80 from the attachment part 370, the worker can insert the tool in the adhesive layer 89 from any of the upper side, the lower side, the front side and the rear side. Thus, the worker can insert the tool in the adhesive layer 89 from a direction from which the worker can easily insert, and, according to the tape cassette 1, the worker can remove the substrate 80 from the arrangement part 370 easily.

Next, referring to FIGS. 12 and 13, a fourth modified embodiment according to aspects of the present disclosures will be described. In the following description, configurations same as those of the above-described embodiment will be assigned with the same reference numbers and description thereof will be omitted. Portions different from the above-described embodiment will be mainly described. It is noted that the fourth modification can also be applied to the first, second and third modified embodiments.

The fourth embodiment is different from the above-described embodiment in that a blocking member 76 is provided to the opening wall 74A. The blocking member 76 is formed integrally with the upper case 51. The blocking member 76 is a plate-like member, and protrudes rightward from the central part, in the front-rear direction, of the opening wall 74A. A right end part of the blocking member 76 protrudes to a position on the upper side with respect to the substrate 80. A length of the blocking member 76 in the front-rear direction is longer than a length of the molded part 84 in the front-rear direction. Therefore, at the position of the phantom line K1, the blocking member 76 overlaps, in the up-down direction, the IC chip 82 and the molded part 84. According to the fourth modified embodiment, the blocking member 76 overlaps the entire IC chip 82 and the entire molded part 84 in the up-down direction.

According to the fourth modified embodiment, the adhesive layer 89 is accessible from the upper side through the opening part 74 at the position of the phantom line K1. Therefore, when the substrate 80 is removed from the attachment part 70, the worker can insert the tool to the adhesive layer 89 through the opening part 74 at the position of the phantom line K1. Thus, the worker can easily remove the substrate 80 from the attachment part 70. Since the blocking member 76 overlaps the molded part 84 in the up-down direction at the position of the phantom line K1, the molded part 84 is covered with the blocking member 76 from the opening part 74 side. Therefore, when the worker inserts the tool into the adhesive layer 89 through the opening part 74 at the position of the phantom line K1, the tool is suppressed from contacting the molded part 84. Therefore, according to the tape cassette 1, when the worker removes the substrate 80 from the attachment part 70, the IC chip 82 is suppressed from being damaged with allowing easy removal of the substrate 80.

Since the blocking member 76 overlaps the entire molded part 84 in the up-down direction, the entire molded part 84 is covered from the opening part 75 with the blocking member 76. Therefore, according to the tape cassette 1, when the worker inserts the tool into the adhesive layer 89 through the opening part 74 at the phantom line K1, contact of the tool with the molded part 84 can be further suppressed.

Since the blocking member 76 is formed integrally with the upper case 51, the upper case 51 and the blocking member 76 can be formed easily in comparison with a case where the upper case 51 and the blocking member 76 are formed separately, and further, strength of the blocking member 76 can easily be increased. Further, positional displacement of the blocking member 76 with respect to the upper case 51 can be suppressed. Furthermore, since it is unnecessary to attach the blocking member 76 to the upper case 51, an attaching error of the blocking member 76 can be suppressed, and a time for assembling the tape cassette 1 can be shortened. Still further, inadvertent removal of the blocking member 76 from the upper case 51 by the user can be suppressed.

Next, referring to FIGS. 14 and 15, a fifth modified embodiment according to aspects of the present disclosures will be described. In the following description, configurations same as those of the above-described embodiment will be assigned with the same reference numbers and description thereof will be omitted. Portions different from the above-described embodiment will be mainly described. It is noted that the fifth modification can also be applied to the first, second and third modified embodiments.

The fifth embodiment is different from the above-described embodiment in that a blocking member 176 is provided to the opening wall 74A. The blocking member 176 is formed integrally with the upper case 51. The blocking member 176 is a plate-like member, and protrudes rightward from the central part, in the front-rear direction, of the opening wall 74A. A right end part of the blocking member 176 protrudes to the left side with respect to the substrate 80. A length of the blocking member 176 in the front-rear direction is longer than a length of the molded part 84 in the front-rear direction. Therefore, at the position of the phantom line K1, the blocking member 176 overlaps, in the up-down direction, the IC chip 82 and the molded part 84. According to the fifth modified embodiment, the blocking member 176 overlaps the left end part of the molded part 84 in the up-down direction.

Since the blocking member 76 overlaps the left end part of the molded part 84 in the up-down direction, the entire molded part 84 is covered from the opening part 75 with the blocking member 176. Therefore, according to the tape cassette 1, when the worker inserts the tool into the adhesive layer 89 through the opening part 74 at the position of the phantom line K1, contact of the tool with the molded part 84 can be further suppressed.

Further modified embodiments described below can be applied to any of the illustrative embodiment and the first-fifth modified embodiments described above. In the following description, the reference numbers in the illustrative embodiment will be referred to only for descriptive purpose. In the illustrative embodiment, the tape cassette 1 is of the laminate type. However, the tape type could be of the receptor type, the thermal type or the tube type and the like. Further, in the illustrative embodiment, the adhesive layer 89 is the both-side adhesive tape, but the adhesive layer 89 may be a layer of adhesive agent or the like.

The opening parts 74 and 75 are provide to the upper part ant the front part of the arrangement part 70. The above configuration may be modified such that only one of the opening part 74 and 75 may be provided. Another opening part may further be provided to the lower end part of the arrangement part 70. The opening part makes the adhesive layer 89 be accessible from the down side. In such a case, the worker my also remove the substrate 80 from the lower side as well as from the upper side and the front side.

In the illustrative embodiment, the IC chip 82 is protected by the molded part 84. The molded part 84 may be omitted. Instead of the relief recess 72, a relief hole may be formed to the tape cassette 1. The relief hole may be configured to penetrate a wall of the arrangement part 70 in the right-left direction. It is noted that the relief hole is an example of a hole according to aspects of the present disclosures. In a state where the substrate 80 is arranged at the arrangement part 70, the IC chip 82 and the molded part 84 are arranged at the relief hole. When the molded part 84 is omitted, the substrate 80 is arranged at the arrangement part 70, while the IC chip 82 is arranged at the relief hole. It is further noted that the tape cassette 1 may be configured such that the relief recess 72 or the relief hole is omitted.

According to the illustrative embodiment, the front side one of the pair of (i.e., two) conductive electrodes 81 overlaps the second discharging port 64B in the right-left direction. The configuration may be modified such that the rear side one of the pair of (i.e., two) conductive electrodes 81 may overlap the second discharging port 64B in the right-left direction. Alternatively, none of the pair of (i.e., two) conductive electrodes 81 may overlap the second discharging port 64B in the right-left direction. That is, for example, a clearance between the pair of (i.e., two) conductive electrodes 81 may overlap the second discharging port 64B in the right-left direction.

The substrate 80 may be configured such that no conductive electrodes 81 may be provided thereto. Alternatively, one conductive electrodes 81, or more than two conductive electrodes 81 may be provide to the substrate 80. According to the illustrative embodiment, the pair of conductive electrodes 81 are metallic electrodes. However, according to an modified embodiment, the electrodes may be conductive resin electrodes. Optionally, on the substrate 80, in addition to the condensers 83, other electronic elements such as coils may be provided. It is preferable that such electronic elements are arranged in the second substrate area S2. In such a configuration, since the electronic elements are arranged in the relief recess 72, the electronic elements are suppressed from being damaged as contacted by the first wall 71 or the second wall 73.

According to the illustrative embodiment, the pair of conductive electrodes 81 has a rectangular shape elongated in the Y2 direction. According to an modified embodiment, the shape of the pair of conductive electrodes 81 may be a rectangular shape elongated in the Y1 direction, or another shape such as a square or circular shape. According to the illustrative embodiment, the two (i.e., pair of) conductive electrodes 81 have the same shapes and arranged in the Y1 direction. According to a modified embodiment, the two conductive electrodes 81 may be configured to have different shapes. Further, the two conductive electrodes 81 may be arranged in the Y2 direction.

On the substrate 80, a communication part may be provided instead of the pair of conductive electrodes 81. The communication part is configured to perform a wireless communication with an external device, and is electrically connected to the IC chip 82. The communication part is, for example, an RF tag. The RF tag may be arranged on the first surface 80A, or the second surface 80B. When the RF tag is arranged on the second surface 80B, it is preferable that the RF tag is arranged in the second substrate area S2. In such a case, the RF tag is arranged in the relief recess 72, a situation where the RF tag contacts the first wall 71 or the second wall 73 and is damaged can be suppressed.

According to the above-identified embodiment, the second discharge port 64B, the arrangement part 70 and the substrate 80 are arranged in the third area R3. However, according to a modified embodiment, the second discharge port 64, the arrangement part 70 and the substrate 80 may be arranged in the first area R1 or the second area R2, or arranged to be bridged among a plurality of areas (e.g., among two or all of the first area R1, the second area R2 and the third area R3). The second discharging port 64B may be arranged on the upper wall 53, the lower wall 54, the right wall 55, the front wall 57 or the rear wall 58. The arrangement part 70 and the substrate 80 may be arranged on the upper wall 53, the lower wall 54, the left wall 56, the front wall 57 or the rear wall 58.

According to the above-described embodiment, the right wall 55 and the first surface 80A area arranged at the same positions in the right-left direction. According to a modified embodiment, the first surface 80A may be arranged on the left side with respect to the right wall 55. According to such a modified configuration, a state where a portion of the substrate 80 protruding rightward with respect to the particular surface 55A is caught and the substrate 80 comes out from the arrangement part 70 when the tape cassette 1 is normally used is suppressed. It is also noted that the first surface 80A may be arranged on the right side with respect to the right wall 55.

According to the illustrative embodiment, the adhesive layer 89 is not provided to the upper end part 89C and the front end part 80D of the second surface 80B. According to a modified embodiment, the adhesive layer 89 may be provided to the upper end part 89C and the front end part 80D of the second surface 80B. According to such a configuration, removal of the substrate 80 from the arrangement part 70 when the tape cassette 1 is normally used can be suppressed.

What is claimed is:

1. A tape cassette configured to accommodate a tape, comprising:

a box-like cassette case having a first outer wall, a second outer wall, a third outer wall, a fourth outer wall, a fifth outer wall and a sixth outer wall, the first outer wall and the second outer wall extending in parallel and being arranged in a first direction perpendicular to both the first outer wall and the second outer wall, the third outer wall and the fourth outer wall extending in parallel and being arranged in a second direction perpendicular to both the third outer wall and the fourth outer wall, the fifth outer wall and the sixth outer wall extending in parallel and being arranged in a third direction perpendicular to both the fifth outer wall and the sixth outer wall, and the first direction, the second direction and the third direction are perpendicular to each other;

a substrate having a first surface and a second surface opposite to the first surface, a storage being provided to the second surface, wherein the third wall is formed with a first recess recessed in a fourth direction which is a one-way direction of the second direction directed from the third wall toward the fourth wall, the first recess having a bottom wall intersecting with the second direction, wherein the bottom wall is formed with one of a second recess recessed in the fourth direction and a hole penetrating through the bottom wall in the fourth direction, wherein the substrate is arranged in the first recess with the first surface facing a direction opposite to the fourth direction and with an adhesive layer being sandwiched between the bottom wall and the second surface, wherein one of the storage and a molded part protecting the storage is arranged in the one of the second recess and the hole, wherein the first recess is formed with an opening part at a particular position in the second direction, at least a part of the adhesive layer being accessible along the first direction through the opening part, and wherein the cassette case is provided with a blocking member overlapping the one of the storage and the molded part in the first direction at the particular position.

2. The tape cassette according to claim 1, wherein the blocking member overlaps the one of the storage and the molded part entirely in the first direction.

3. The tape cassette according to claim 1, wherein the blocking member overlaps, in the first direction, an end part of the one of the storage and the molded part in the fourth direction.

4. The tape cassette according to claim 3, wherein the cassette case has a first case and a second case arranged in the first direction, wherein the first case includes at least the first outer wall, wherein the second case includes at least the second outer wall, and wherein the blocking member is formed integrally with one of the first case and the second case.

5. The tape cassette according to claim 1, further comprising a discharging port allowing the tape to be discharged, wherein the discharging port is provided to the fourth outer wall, wherein the first recess is formed to the third outer wall, and wherein at least a part of the discharging port and at least a part of the first recess overlap each other in the second direction.

6. The tape cassette according to claim 1, wherein the adhesive layer is provided to a portion of the substrate other than an end portion of the substrate defining the opening part.

7. The tape cassette according to claim 1, wherein the adhesive layer is formed by a both-side adhesive tape having a base material and adhesive layers formed on both sides of the base material.

8. The tape cassette according to claim 1, wherein the bottom wall includes, in the third direction, a first bottom wall and a second bottom wall with the one of the second recess and the hole arranged therebetween, and wherein the substrate is arranged in the first recess with the adhesive layer being located between each of the first bottom wall and the second bottom wall, and the second surface.

9. The tape cassette according to claim 1, wherein the bottom wall extends in parallel with the second surface.

10. The tape cassette according to claim 1, wherein an entirety of the substrate is arranged within an area surrounded by end part of the third outer wall when viewed in the second direction.

11. The tape cassette according to claim 1, wherein a first distance between the fifth outer wall and the sixth outer wall is larger than a second distance between the first outer wall and the second outer wall, and wherein a third distance between the third outer wall and the fourth outer wall is larger than the first distance.

12. The tape cassette according to claim 1, further comprising a supporting part provided between the first outer wall and the second outer wall, the supporting part extending in the first direction, the supporting part supporting a tape roll configured by winding the tape.

13. The tape cassette according to claim 1, wherein a conductive electrode electrically connected to the storage is provided to the first surface.

* * * * *